US009277796B1

(12) United States Patent
Elam

(10) Patent No.: US 9,277,796 B1
(45) Date of Patent: Mar. 8, 2016

(54) PORTABLE DESK

(71) Applicant: Marrell Elam, Woodbridge, VA (US)

(72) Inventor: Marrell Elam, Woodbridge, VA (US)

( * ) Notice: Subject to any disclaimer, the term of this patent is extended or adjusted under 35 U.S.C. 154(b) by 251 days.

(21) Appl. No.: 13/954,065

(22) Filed: Jul. 30, 2013

(51) Int. Cl.

| | |
|---|---|
| ***A45C 5/14*** | (2006.01) |
| ***A45C 9/00*** | (2006.01) |
| *A45C 7/00* | (2006.01) |
| *A45C 13/28* | (2006.01) |
| *A45C 13/26* | (2006.01) |

(52) U.S. Cl.
CPC ... *A45C 9/00* (2013.01); *A45C 5/14* (2013.01); *A45C 5/145* (2013.01); *A45C 7/00* (2013.01); *A45C 13/28* (2013.01); *A45C 2013/267* (2013.01)

(58) Field of Classification Search
CPC ..... A45C 9/00; A45C 5/14; A45C 7/00; A45C 13/28; A45C 2013/267; A45C 5/145
See application file for complete search history.

(56) References Cited

U.S. PATENT DOCUMENTS

| | | | | |
|---|---|---|---|---|
| 2,842,373 | A * | 7/1958 | Duerr | 280/47.19 |
| 2,888,761 | A * | 6/1959 | Miller | B62B 3/1428 186/62 |
| 4,423,888 | A * | 1/1984 | Addison | 281/45 |
| 4,496,058 | A * | 1/1985 | Harris | B43L 3/008 206/557 |
| 4,848,117 | A * | 7/1989 | Welborn | B62B 3/1428 211/45 |
| 5,961,134 | A * | 10/1999 | Congleton et al. | 280/47.18 |
| 7,219,822 | B2 * | 5/2007 | Chretien et al. | 224/411 |
| 7,946,609 | B2 * | 5/2011 | Johnson et al. | 280/652 |
| 8,613,349 | B1 * | 12/2013 | Halko et al. | 190/11 |
| 2005/0098402 | A1 * | 5/2005 | Cohen | 190/12 A |
| 2007/0089952 | A1 * | 4/2007 | Herbst et al. | 190/8 |
| 2009/0255771 | A1 * | 10/2009 | Puchalski | 190/18 A |
| 2010/0236884 | A1 * | 9/2010 | Brown | 190/11 |
| 2013/0032443 | A1 * | 2/2013 | Soedomo | 190/11 |

* cited by examiner

*Primary Examiner* — Tri Mai

(57) ABSTRACT

The portable desk is constructed of a bag that may store an electronic device. A stand operationally coupled to the bag so the stand is selectively extendable from the bag. A table movably coupled to the stand so the table may selectively support the electronic device. A stabilizer operationally coupled to the bag so the stabilizer to stabilize the bag.

1 Claim, 4 Drawing Sheets

PORTABLE DESK

CROSS REFERENCES TO RELATED APPLICATIONS

Not applicable

STATEMENT REGARDING FEDERALLY SPONSORED RESEARCH

Not applicable

REFERENCE TO APPENDIX

Not applicable

BACKGROUND OF THE INVENTION

A. Field of the Invention

The present invention relates to the field of desks, more specifically, a desk that is also a piece of luggage.

SUMMARY OF THE INVENTION

An embodiment of the disclosure meets the needs presented above by generally comprising a bag that may store an electronic device. A stand operationally coupled to the bag so the stand is selectively extendable from the bag. A table movably coupled to the stand so the table may selectively support the electronic device. A stabilizer operationally coupled to the bag so the stabilizer to stabilize the bag.

An object of the invention is to provide a device that is a piece of luggage from which a table is able to extend upwardly forming a desk surface.

These together with additional objects, features and those of ordinary skill in the art upon reading the following detailed description of presently preferred, but nonetheless illustrative, embodiments of the portable desk when taken in conjunction with the accompanying drawings.

In this respect, before explaining the current embodiments of the portable desk in detail, it is to be understood that the portable desk is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable desk.

It is therefore important that the claims be regarded as including such equivalent construction insofar as they do not depart from the spirit and scope of the portable desk. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
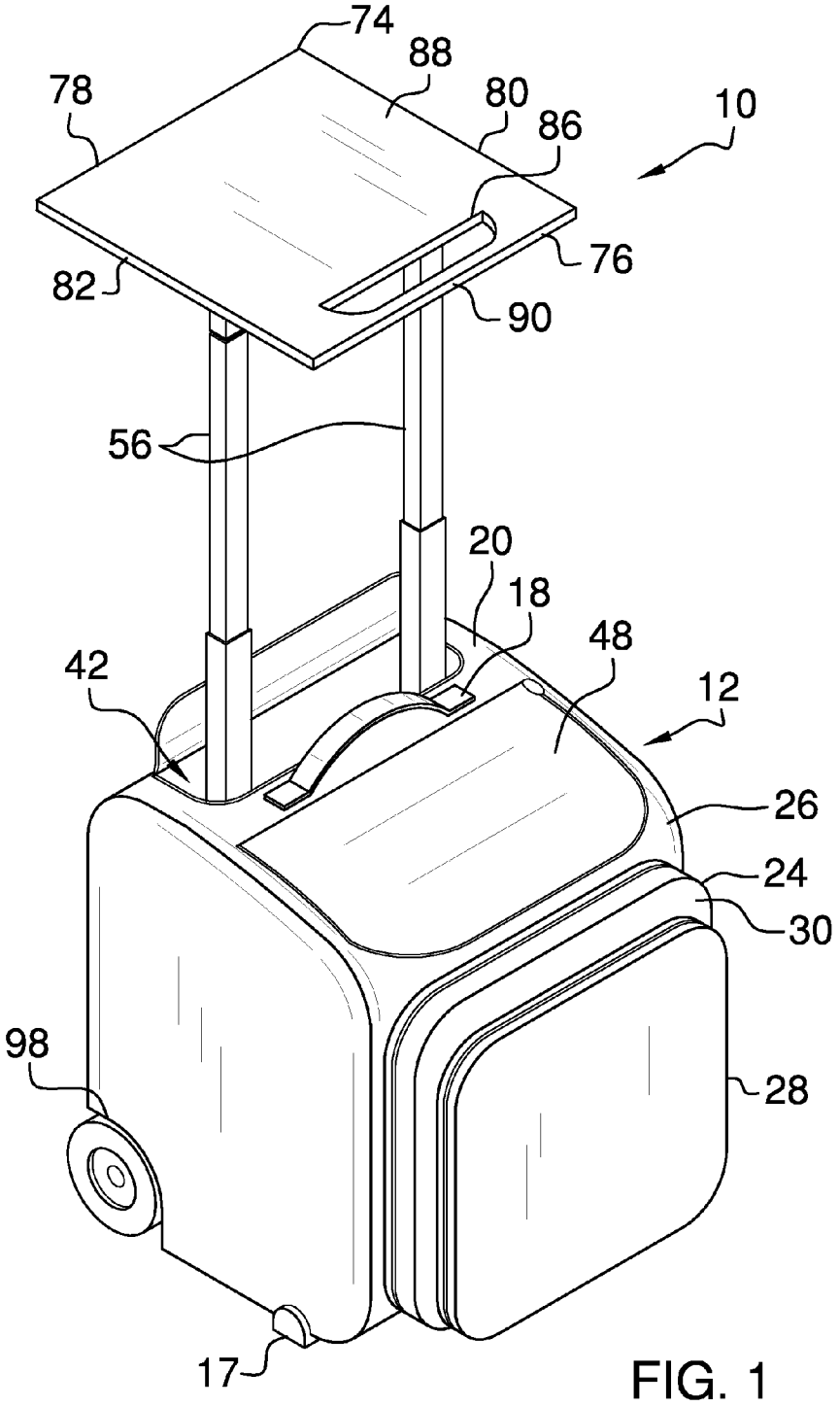
FIG. 1 is a front perspective view of a portable table assembly according to an embodiment of the disclosure.
Figure 2:
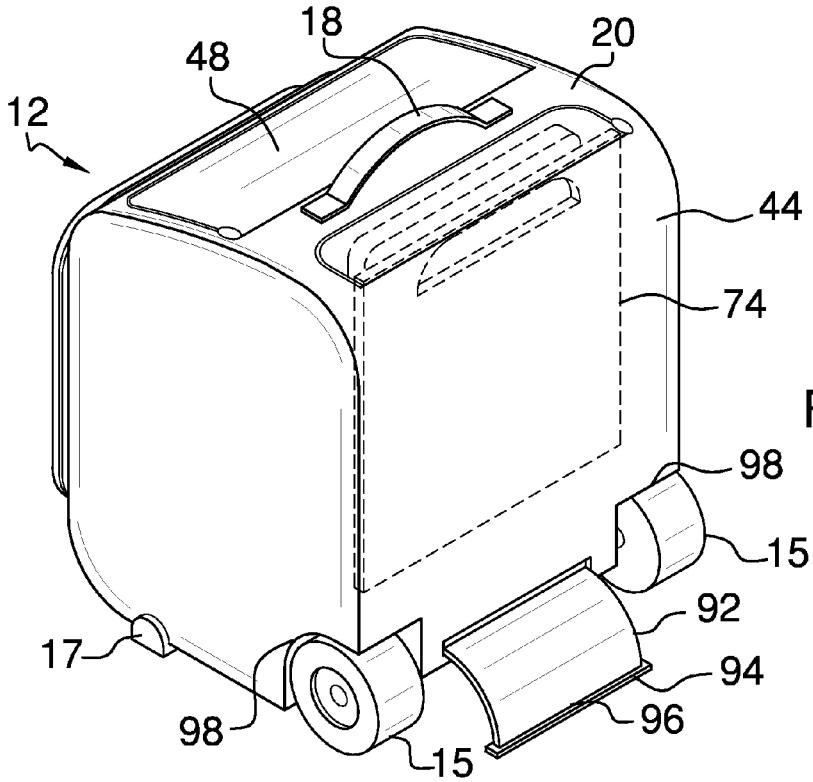
FIG. 2 is a back perspective view of an embodiment of the disclosure.
Figure 3:
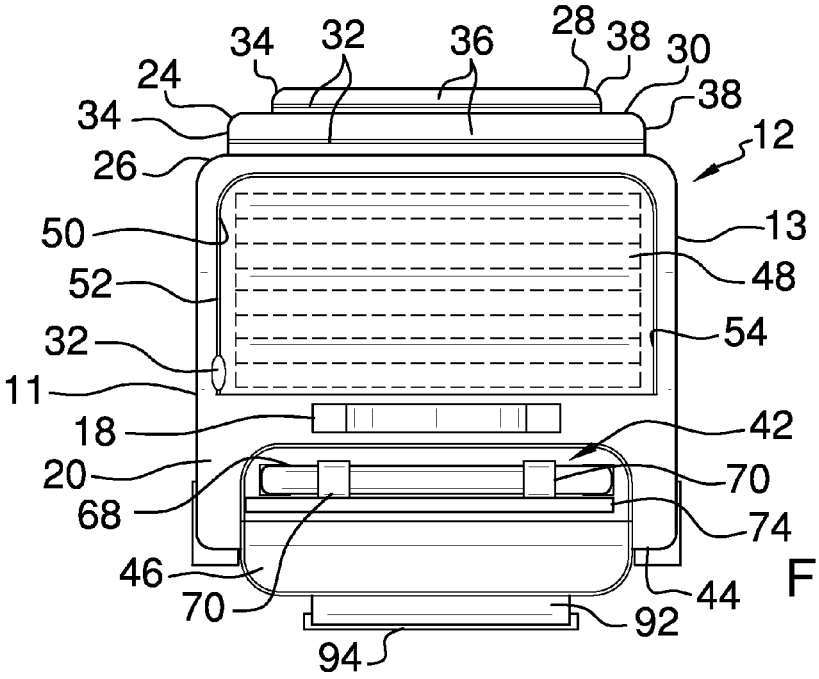
FIG. 3 is a top view of an embodiment of the disclosure.
Figure 4:
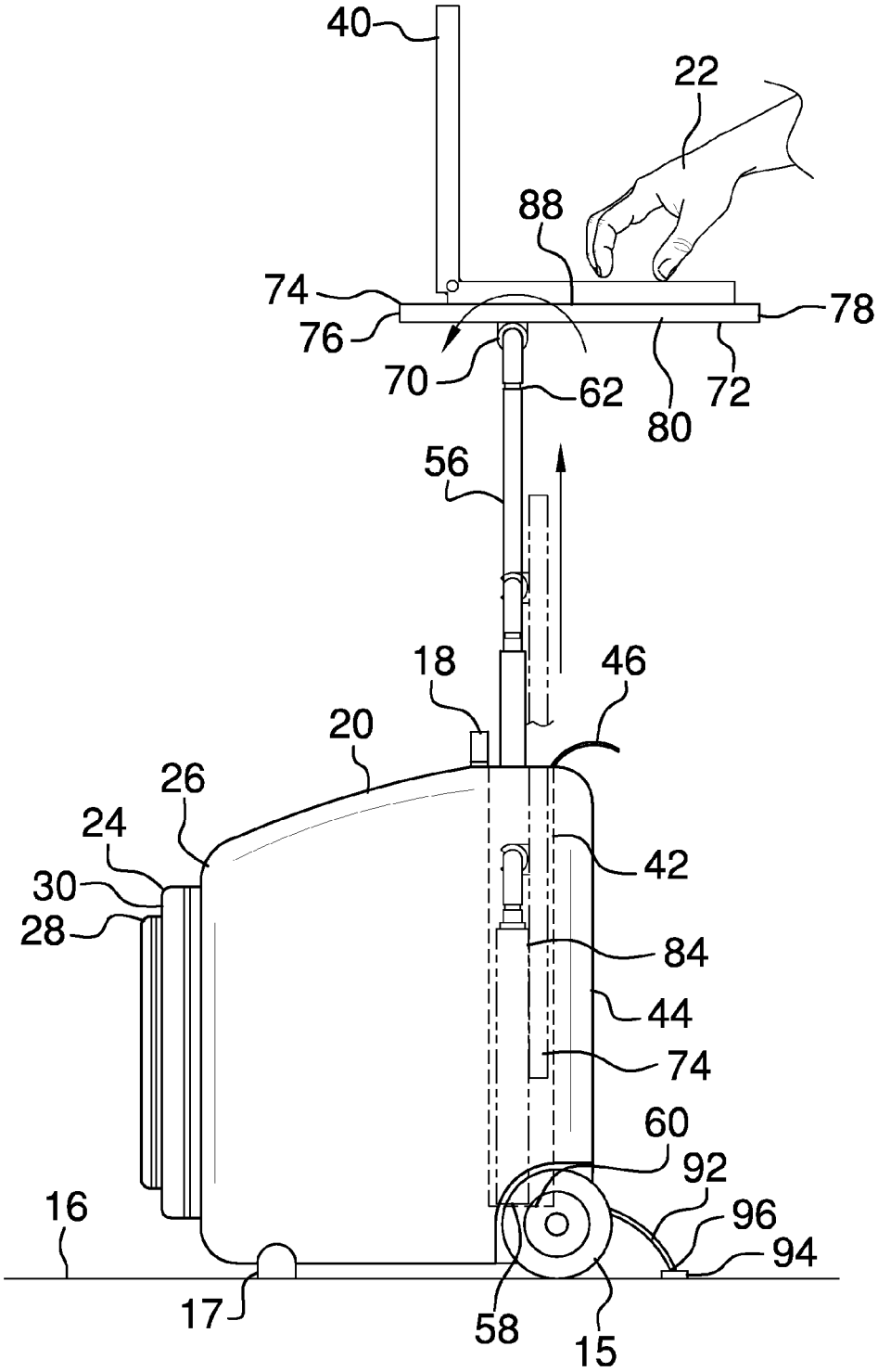
FIG. 4 is a left side view of an embodiment of the disclosure.
Figure 5:
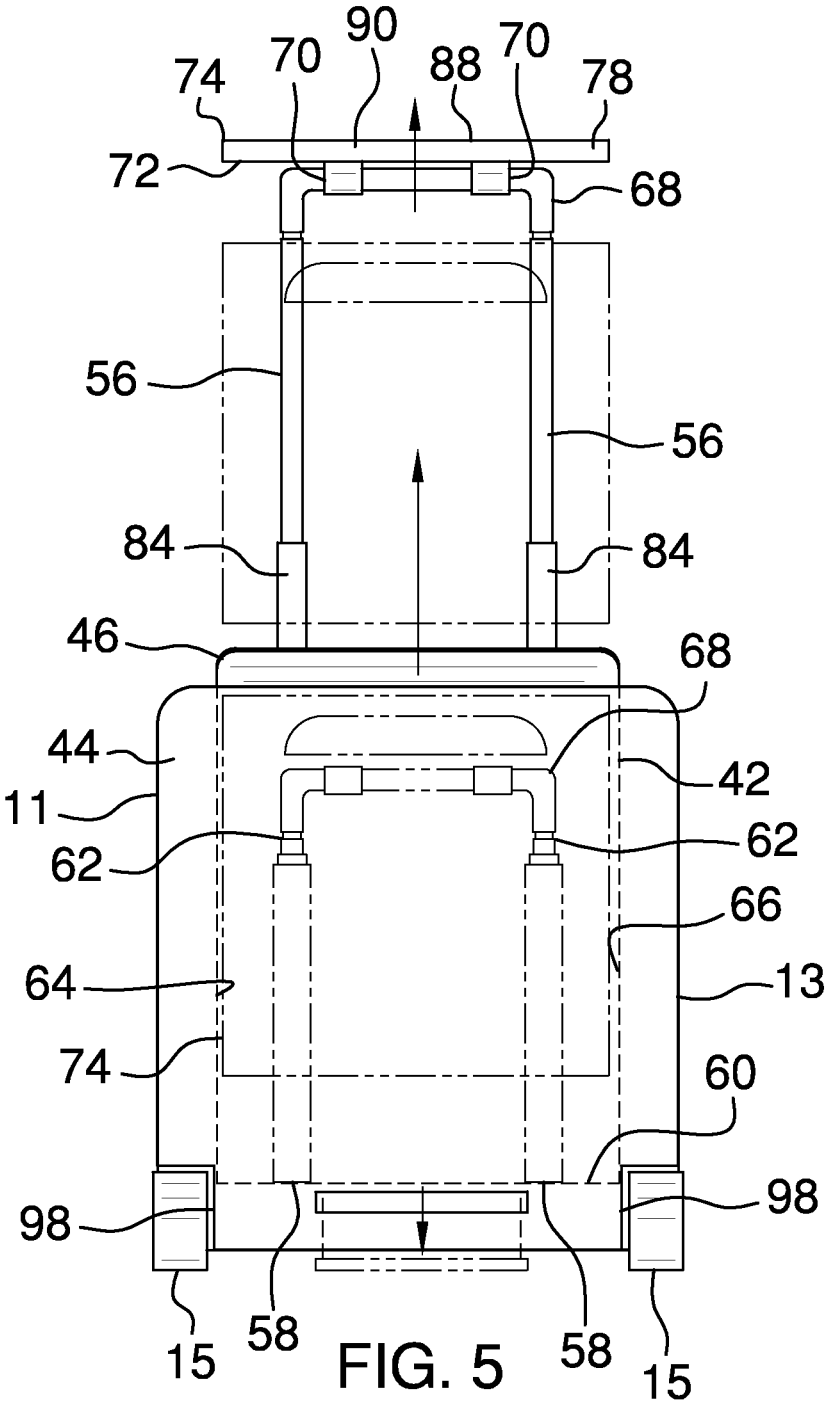
FIG. 5 is a back view of an embodiment of the disclosure.

As best illustrated in FIGS. 1 through 5, the portable table assembly 10 generally comprises a bag 12 that has a cubic shape so a bottom side 14 of the bag 12 may abut a support surface 16. The bag 12 may have a height between 50 cm and 76 cm, a width between 40 cm and 60 cm and a depth between 40 cm and 60 cm. A handle 18 is coupled to a top side 20 of the bag 12. The handle 18 may be gripped by a user 22 to transport the bag 12.

A large pouch 24 is coupled to a front side 26 of the bag 12. A small pouch 28 is coupled to a front side 30 of the large pouch 24. Additionally, a pair of fasteners 32 is coupled to an associated one of the large 24 and small 28 pouches. Each of the pairs of fasteners 32 extends along a first lateral side 34, top side 36 and second lateral side 38 of the associated one of the large 24 and small 28 pouches. Lastly, each of the pair of fasteners 32 may comprise a zipper of any conventional design. The large pouch 24 may store an electronic device 40. The electronic device 40 may be a laptop computer of any conventional design.

A stand well 42 extends downwardly into the top side 20 of the bag 12 proximate a back side 44 of the bag. Continuing, a flap 46 is coupled to the top side 20 of the bag 12. The flap 46 selectively covers the stand well 42. A cover 48 is coupled to the top side 20 of the bag 12. The cover 48 selectively covers an opening 50 to access an interior of the bag 12. The interior of the bag 12 may store a plurality of files or other similar items. A fastener 32 is coupled to a perimeter edge 52 of the cover 48. The fastener 32 engages a perimeter edge 54 of the opening 50. Moreover, the fastener 32 may comprise a zipper of any conventional design.

A stand 56 is operationally coupled to the bag 12. Continuing, a bottom end 58 of the stand 56 is coupled to a bottom 60 of the stand well 42 so the stand 56 extends between the bottom 60 of the stand well 42 and the top side 20 of the bag 12. The stand 56 is telescopic. The stand 56 is positionable in an extended position so a top end 62 of the stand 56 extends outwardly from the stand well 42 and upwardly from the top side 20 of the bag 12. Moreover, the stand 56 is positionable in a stored position so the top end 62 of the stand 56 is positioned within the stand well 42 below the top side 20 of the bag 12.

The stand 56 may have a maximum height between 100 cm and 120 cm. Continuing, the stand 56 is one of a pair of the stands 56 each positioned proximate an associated one of a first lateral side 64 and a second lateral side 66 of the stand well 42. A U-shaped handle 68 is coupled between the top end 62 of each of the pair of stands 56. The U-shaped handle 68 may have a length between 15 cm and 20 cm.

A clip 70 is coupled to a bottom side 72 of a table 74. The clip 70 forms an open loop. Additionally, the clip 70 is positioned closer to a front edge 76 of the table 74 than a back edge 78 of the table 74. The clip 70 is one of a pair of clips 70 each positioned proximate an associated one of a first lateral edge 80 and a second lateral edge 82 of the table 74. Lastly, the pair of clips 70 rotatably engages the U-shaped handle 68 so the table 74 is rotatably coupled to the U-shaped handle 68.

The table 74 is positionable in a stored position so the bottom side 72 of the table 74 abuts a back side 84 of each of the pair of stands 56. The table 74 is positionable in a deployed position after the pair of stands 56 is positioned in an extended position. In the deployed position, the bottom side 72 of the table 74 lies on a plane that is perpendicular to a longitudinal axis extending through the top 62 and bottom 60 ends of the pair of stands 56. The table 74 may selectively support the electronic device 40 so the electronic device 40 is accessible to the user 22.

A grab aperture 86 extends through a top side 88 and the bottom side 72 of the table 74 proximate the back edge 78 of the table 74. The grab aperture 86 may be gripped by a user 22 to position the pair of stands 56 into the extended position. Additionally, the grab aperture 86 has a semi-circular shape. Finally, the grab aperture 86 is positioned proximate a middle 90 of the back edge 78 of the table 74.

A stabilizer 92 is movably coupled to the back side 44 of the bag proximate the bottom side 14 of the bag 12. The stabilizer 92 is curved so the stabilizer 92 defines a circular arc. A foot 94 is coextensively coupled to a bottom end 96 of the stabilizer 92. Continuing, the stabilizer 92 is positionable in an extended position so the foot 94 abuts the support surface 16. The stabilizer 92 prevents the bag 12 from tipping over when the electronic device 40 is positioned on the table 74. Moreover, the stabilizer 92 is positionable in a stored position so the foot 94 is positioned proximate the back side 44 of the bag 12.

A pair of wheel wells 98 extends into an associated one of a first lateral side 11 and a second lateral side 13 of the bag 12 proximate an intersection of the back side 44 and the bottom side 14 of the bag 12. A pair of wheels 15 is rotatably coupled to bag 12. Each of the pair of wheels 15 is positioned within an associated one of the pair of wheel wells 98. The wheels 15 may roll along the support surface 16. A semi-circular rest 17 is coupled to the bottom side 14 of the bag 12 proximate the front side 26 of the bag 12. The semi-circular rest 17 is one of a pair of semi-circular rests 17 each positioned proximate an associated one of the first 11 and second 13 lateral sides of the bag 12. The pair of semi-circular rests 17 may abut the support surface 16.

In use, the user 22 positions the pair of stands 56 in the extended position. Continuing, the user 22 positions the table 74 in the deployed position. The user 22 further positions the stabilizer 92 in the extended position to prevent the bag 12 from tipping. Lastly, the user 22 places the electronic device 40 on the table 74 so the user 22 may access the electronic device 40.

With respect to the above description, it is to be realized that the optimum dimensional relationship for the various components of the portable table assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the portable table assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable table assembly for providing a storable support surface for an electronic device comprising:

a bag configured to store the electronic device;

a stand operationally coupled to said bag wherein said stand is selectively extendable from said bag;

a table movably coupled to said stand wherein said table is configured to selectively support the electronic device;

a stabilizer operationally coupled to said bag wherein said stabilizer to stabilizes said bag;

wherein a clip coupled to a bottom side of said table wherein said clip is positioned closer to a front edge of said table than a back edge of said table;

wherein said clip being one of a pair of said clips each positioned proximate an associated one of a first lateral edge and a second lateral edge of said table;

wherein said pair of clips rotatably engaging a U-shaped handle wherein said table is rotatably coupled to said U-shaped handle;

wherein said stabilizer being curved wherein said stabilizer defines a circular arc;

said bag has a cubic shape wherein a bottom side of said bag is configured to abut a support surface;

wherein a stand well extending downwardly into a top side of said bag proximate a back side of said bag;

wherein a bottom end of said stand being coupled to a bottom of a stand well; wherein said stand extends between said bottom of said stand well and a top side of said bag;

said stand being telescopic wherein said stand is positionable in an extended position wherein a top end of said stand extends outwardly from a stand well and upwardly from a top side of said bag;

wherein said stand being positionable in a stored position wherein a top end of said stand is positioned within a stand well below a top side of said bag;

wherein comprising said stand being one of a pair of said stands each positioned proximate an associated one of a first lateral side and a second lateral side of a stand well;

wherein a U-shaped handle coupled between a top end of each of a pair of said stands;

wherein said table being positionable in a stored position wherein a bottom side of said table abuts a back side of each of a pair of said stands;

wherein said table being positionable in a deployed position after said stand is positioned in an extended position wherein a bottom side of said table lies on a plane being perpendicular to a longitudinal axis extending through a top end and a bottom end of a pair of said stands;

wherein a grab aperture extending through a top side and a bottom side of said table proximate a back edge of said table wherein said grab aperture is configured to be gripped by a user wherein said stand is positionable in an extended position;

wherein said stabilizer being movably coupled to a back side of said bag proximate a bottom side of said bag;

wherein said stabilizer being positionable in an extended position wherein a bottom end of said stabilizer abuts a support surface;

wherein said stabilizer being positionable in a stored position wherein a bottom end of said stabilizer is positioned proximate a back side of said bag;

wherein a pair of wheels rotatably coupled to an associated one of a first lateral side and a second lateral side of said bag proximate a bottom side of said bag wherein said wheels are configured to roll along a support surface.

* * * * *